US007686178B2

(12) United States Patent
Grant et al.

(10) Patent No.: US 7,686,178 B2
(45) Date of Patent: Mar. 30, 2010

(54) FLASK

(75) Inventors: Robert P. Grant, Alpharetta, GA (US); Malcolm Kinmont, Atlanta, GA (US); Tracy M. Momany, Sylvania, OH (US); Daniel L. Witham, Holland, OH (US); Jonathan A. McGurk, Toledo, OH (US); Frank E. Semersky, Holland, OH (US); Barbara A. Balyeat, Toledo, OH (US); Sumit Mukherjee, Sylvania, OH (US); David M. Ryan, Toledo, OH (US); Robert J. Groll, Oregon, OH (US); Martin T. Geithmann, Maumee, OH (US)

(73) Assignee: The Coca-Cola Company, Atlanta, GA (US)

( * ) Notice: Subject to any disclaimer, the term of this patent is extended or adjusted under 35 U.S.C. 154(b) by 1188 days.

(21) Appl. No.: 11/163,747

(22) Filed: Oct. 28, 2005

(65) Prior Publication Data

US 2007/0095783 A1 May 3, 2007

(51) Int. Cl.
*B65D 1/02* (2006.01)
*B65D 23/10* (2006.01)

(52) U.S. Cl. ..... 215/384; 215/375; 215/398; 220/609; 220/675; 220/771

(58) Field of Classification Search ..... 215/379, 215/384, 398, 371, 375; 220/672, 771, 914, 220/DIG. 13, 606, 608, 609, 675
See application file for complete search history.

(56) References Cited

U.S. PATENT DOCUMENTS

| | | | | | |
|---|---|---|---|---|---|
| D134,077 | S | * | 10/1942 | Clark | D9/541 |
| D214,429 | S | * | 6/1969 | Josephsen | D9/541 |
| 4,785,949 | A | | 11/1988 | Krishnakumar et al. | 215/1 C |
| 4,785,950 | A | | 11/1988 | Miller et al. | 215/1 C |
| 5,518,143 | A | * | 5/1996 | Iodice | 220/708 |
| 5,620,112 | A | * | 4/1997 | Brown | 220/703 |
| 5,887,774 | A | * | 3/1999 | Bethune | 224/414 |
| 5,908,107 | A | * | 6/1999 | Baudin | 206/221 |
| 6,145,681 | A | * | 11/2000 | Chimetto et al. | 215/384 |
| D465,151 | S | * | 11/2002 | Mixon | D9/668 |
| D484,810 | S | * | 1/2004 | Rosen | D9/559 |
| 6,966,441 | B2 | * | 11/2005 | Barham et al. | 206/362.2 |
| D519,839 | S | * | 5/2006 | Abadinsky | D9/502 |
| D519,842 | S | * | 5/2006 | Abadinsky | D9/542 |
| D584,161 | S | * | 1/2009 | Barker | D9/668 |

FOREIGN PATENT DOCUMENTS

| | | |
|---|---|---|
| EP | 1022223 A1 | 7/2000 |
| EP | 1179482 A1 | 2/2002 |
| JP | 09-077037 | 3/1997 |
| WO | 00/42878 | 7/2000 |

* cited by examiner

*Primary Examiner*—Sue A Weaver
(74) *Attorney, Agent, or Firm*—Sutherland Asbill & Brennan LLP

(57) ABSTRACT

A beverage bottle. The bottle may include a flattened upper lobe, a flattened lower lobe, and a substantially circular transitional section. The bottle may be made out of a plastic material.

18 Claims, 7 Drawing Sheets

FLASK

TECHNICAL FIELD

The present invention relates generally to a bottle and more particularly relates to a plastic pocket flask suitable for use with a carbonated soft drink and the associated internal pressure.

BACKGROUND OF THE INVENTION

Beverage bottles come in numerous shapes and sizes. Plastic beverage bottles intended for single serving sizes, particularly those intended for use with carbonated soft drinks, tend to be largely cylindrical due to the internal pressure created therein. This is due to the fact that non-cylindrical bottle shapes may tend to deform under pressure. Such cylindrical bottles, however, generally do not fit within a consumer's pocket for easy transport.

There is a desire, therefore, for a plastic beverage container that may be largely "pocket sized" or non-cylindrical while accommodating the typical internal pressures associated with a carbonated soft drink and the like. Further, larger sized containers could benefit from easier handling, storage, and refrigeration. Such containers preferably can be manufactured and filled with existing bottling equipment, transported to the consumer without deformation, and be easy for the consumer to use.

SUMMARY OF THE INVENTION

The present application thus describes a beverage bottle. The bottle may include a flattened upper lobe, a flattened lower lobe, and a substantially circular transitional section. The bottle may be made out of a plastic material. The bottle may include a carbonated soft drink therein.

A front view of the bottle may include a substantially hour glass shape while a side view may include a substantially oval shape lengthwise. The flattened upper lobe and the flattened lower lobe may have the same or a different diameter. The flattened upper lobe and the flattened lower lobe may have the same or a different shape. The flattened upper lobe and the flattened lower lobe may have an oval shape.

The bottle further may include a bottom with a number of feet positioned adjacent to the flattened lower lobe. The bottom may include a pair of ribs positioned between the feet. The ribs may extend into the flattened lower lobe. The bottom may have an oval cross-section.

The present application further describes a beverage bottle. The beverage bottle may include a first section and a second section with a substantially oval cross-section and a third section positioned in between the first section and the second section with a substantially circular cross-section. A front view may include a substantially hour glass shape while a side view may include a substantially oval shape. The bottle further may include a number of feet positioned adjacent to the second section. A pair of ribs may be positioned between the feet. The feet may have a substantially oval cross-section.

The present application further describes a beverage bottle. The beverage bottle may include an oval first cross-section, a circular second cross-section, an oval third cross-section, and an oval bottom with a number of feet. The bottom may include a pair of ribs positioned between the feet. The ribs may include a long rib and a short rib. The feet may include an identical shape or the feet may include a pair of small feet and a pair of large feet.

The present application further describes a beverage bottle. The beverage bottle may include a body and a bottom. The bottom may include an oval cross-section and a number of feet. The bottom may include a pair of ribs positioned between the feet. The ribs may include a long rib and a short rib. The feet may include an identical shape or a pair of small feet and a pair of large feet. The bottle further may include an internal web positioned therein. The web may be positioned across a shorter diameter of the oval width.

These and other features of the present application will become apparent to one of ordinary skill in the art upon review of the following detailed description of the invention when taken in conjunction with the several drawings and the appended claims.

DETAILED DESCRIPTION

Figure 1:
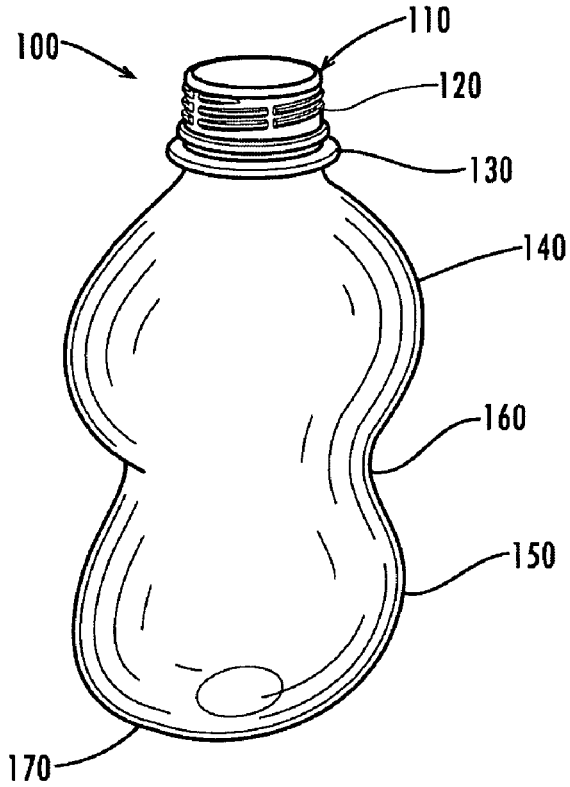
FIG. 1 is a perspective view of a bottle as is described herein.

Referring now to the drawings, in which like numerals refer to like parts throughout the several views, FIGS. 1-6 show an embodiment of a flask 100 as is described herein. Although the term "flask" is used in the context of a relatively flat container, the flask 100 may be any type or size of bottle or receptacle. The flask 100 may be made out of conventional thermoplastics such as PET-based (Polyethylene Terephthalate) materials and the like. Other types of materials such as glass, metal, and the like may be used herein. The flask 100 may be manufactured in a conventional stretch blow molding process. Other types of manufacturing processes may be used herein.

The flask 100 may include a neck portion 110. The neck portion 110 may be of conventional design. The neck portion 110 may include a number of threads 120. The threads 120 may be configured to accept a conventional twist off closure. Other types of closures may be used herein. A retaining ring 130 or similar structures also may be used.

Figure 4:
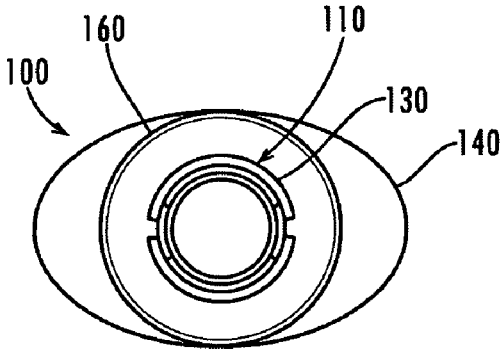
FIG. 4 is a top plan view of the bottle of FIG. 1.
Figure 5:
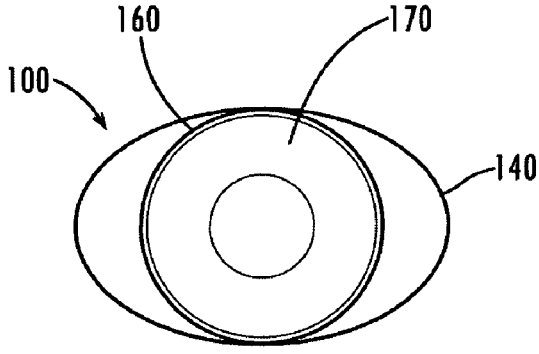
FIG. 5 is a bottom plan view of the bottle of FIG. 1.
Figure 2:
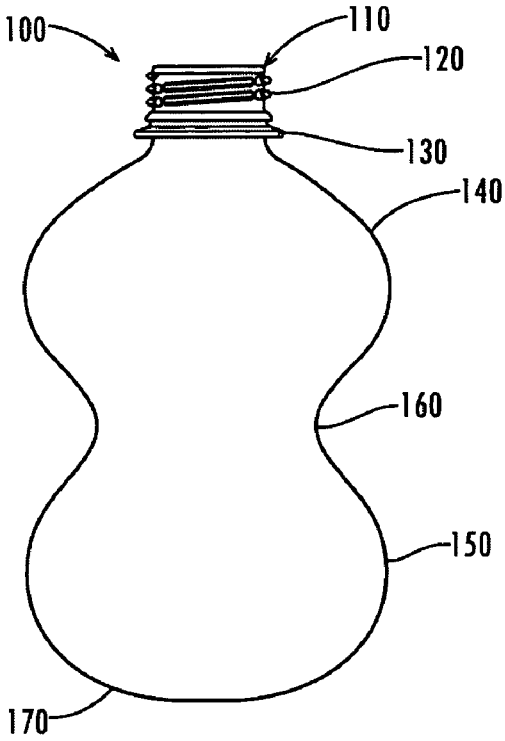
FIG. 2 is a front plan view of the bottle of FIG. 1.
Figure 3:
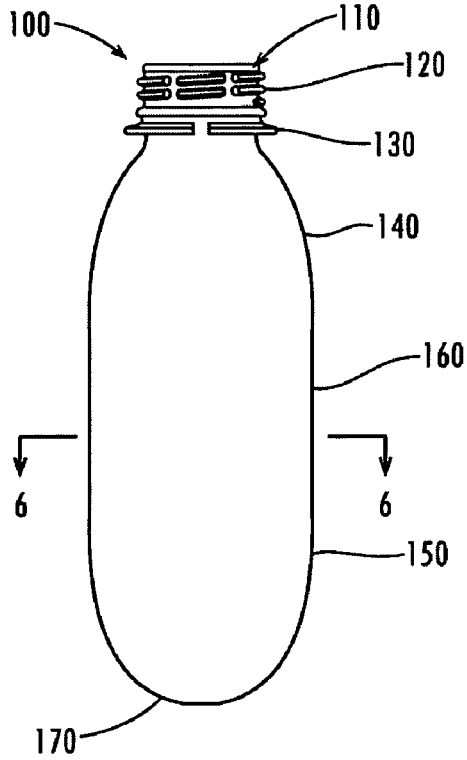
FIG. 3 is a side plan view of the bottle of FIG. 1.
Figure 6:
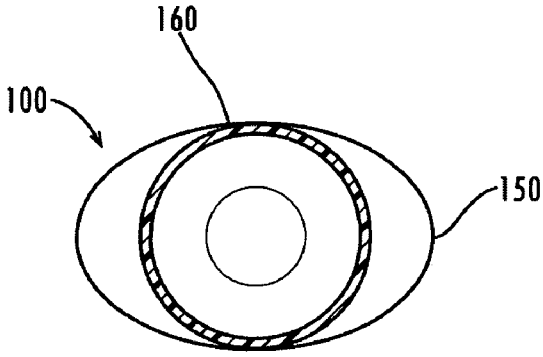
FIG. 6 is a cross sectional view taken through axis 6-6 of FIG. 3 thereof.

The bottle 100 further may have an upper section 140 and a lower section 150. The upper section 140 and the lower section 150 may be separated by a transitional middle section 160. The upper and the lower sections 140, 150 may be largely oval in shape and make take the form of substantially flattened lobes. The middle section 160, however, may be substantially circular in cross-sectional shape. As is shown in FIG. 2, the front view of the upper section 140 begins in a largely concave manner away from the neck portion 110 and then proceeds in a convex manner towards the middle section 160. Likewise, the lower section 150 extends in a largely concave fashion away from the middle section 160 and then proceeds in a convex manner towards a bottom 170. The front view thus has a substantial "hour glass" shape. As viewed from the top or bottom as seen in FIGS. 3 and 4, or from the side as seen in FIG. 3, however, the flask 100 appears to be largely oval in shape. The combination of the oval upper section 140 or the oval lower section 150 with the circular middle section 160 is shown most clearly in the cross-sectional view of FIG. 6.

The combination of the oval upper and lower sections 140, 150 with the largely circular middle section 160 allows the flask 100 as a whole to have a somewhat flattened shape while being able to avoid deformation due to the internal pressures of the beverage therein. For example, the flask 100 should be able to accommodate the typical internal pressures of a carbonated soft drink in the range of about two (2) volumes $CO_2$ per atmosphere to about five (5) volumes $CO_2$ per atmosphere. The flattened lobe shape also provides for ease of handling in transport while the circular middle section 160 provides for ease of gripping. Although the flask 100 may be "pocket sized", any size may be used herein. In fact, larger containers may benefit from the easy to use shape.

Figure 7:
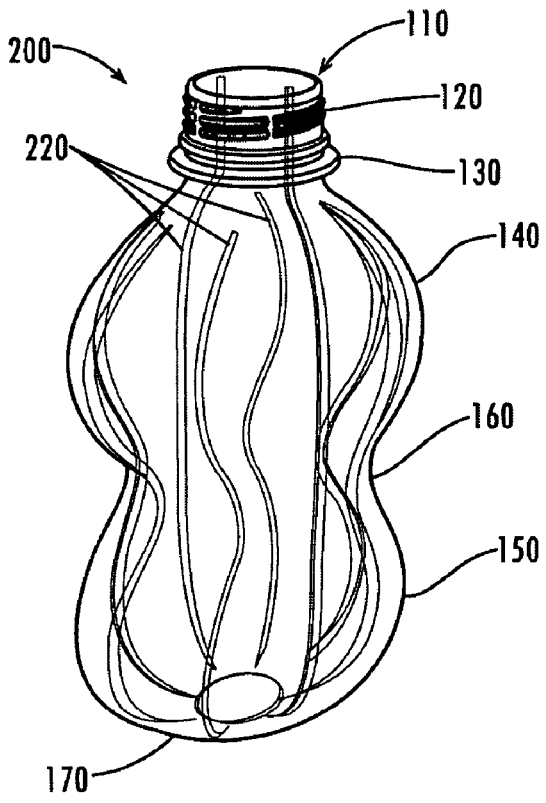
FIG. 7 is a perspective view of an alternative embodiment of a bottle as is described herein.

FIG. 7 shows a further embodiment as is described herein of a flask 200. The flask 200 may be largely similar to the flask 100 described above but with the addition of a number of internal ribs 220 that extend along the length of the upper and lower sections 140, 150 and middle second 160. The ribs 220 may be slight indentations into or out of the upper and the lower sections 140, 150 and middle second 160 so as to provide further structural strength and aesthetic value. Other types of reinforcing means also may be used herein as desired. The flask 200 may have other types of surface features such as scalloping, embossing, and the like while still maintaining a largely oval or non-circular cross-sectional shape.

Figure 8:
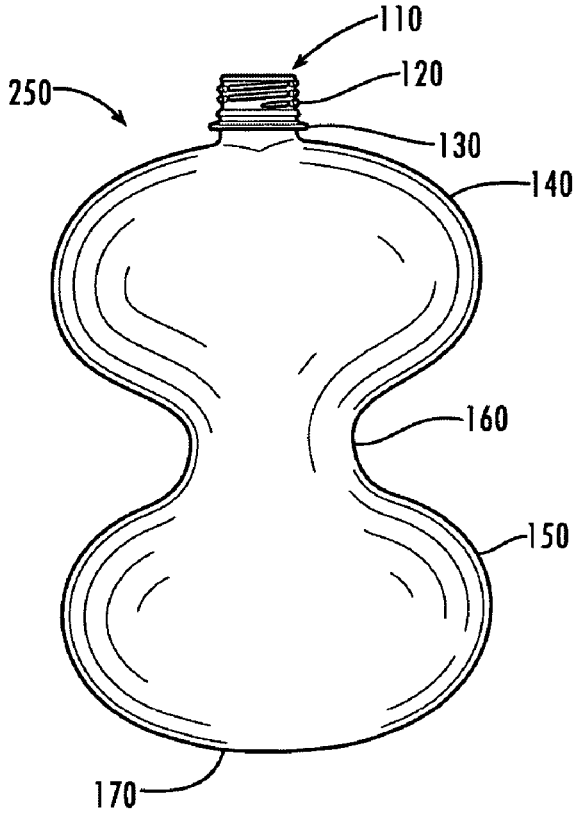
FIG. 8 is a front plan view of an alternative embodiment of a bottle as is described herein.
Figure 9:
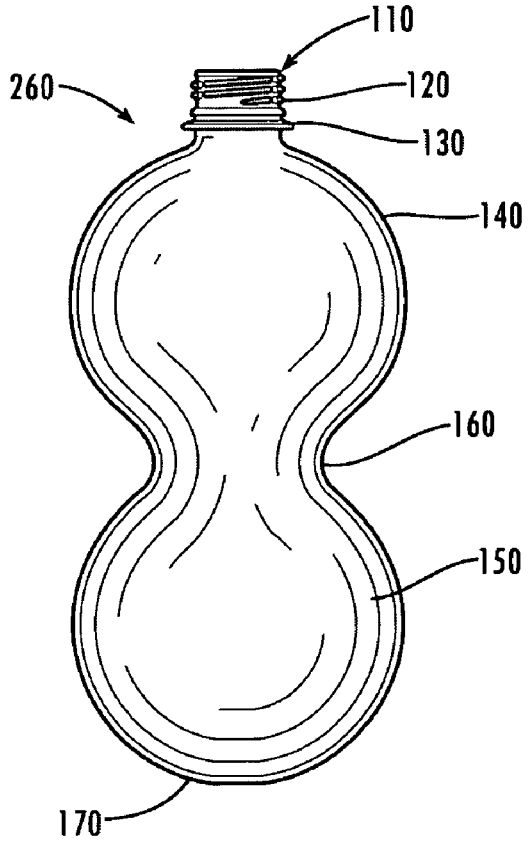
FIG. 9 is a front plan view of an alternative embodiment of a bottle as is described herein.

The upper and the lower sections 140, 150, as well as the flask 100 as a whole, may take many different configurations. For example, FIG. 8 shows a further embodiment as is described herein of a flask 250. The flask 250 is similar to that described above with respect to the flask 100 but the upper and the lower sections 140, 150 are further extended such that the horizontal dimension of the upper and lower section 140 is much greater as compared to that of the middle section 160. The top and side views may remain largely oval in appearance. FIG. 9, conversely, shows a further embodiment as is described herein of a flask 260. The flask 260 is similar to that described above with respect to the flask 100 but the upper and the lower sections 140, 150 are minimized such that the horizontal dimension of the upper and lower section 140 is not as great as compared to that of the middle section 160. The top and side views may remain largely oval in appearance.

Figure 10:
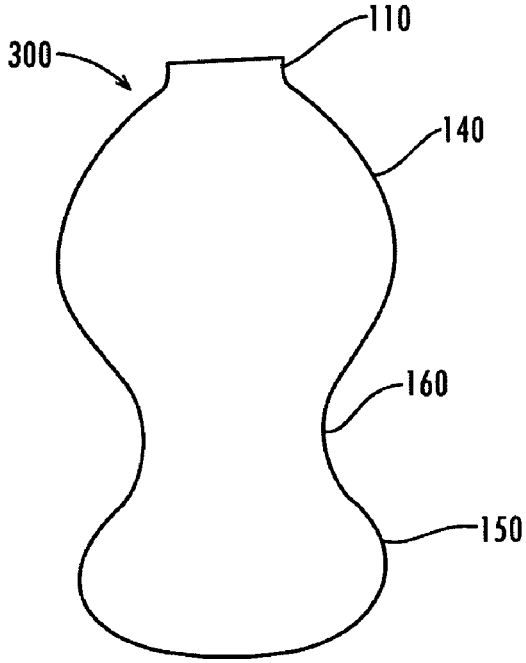
FIG. 10 is a front plan view of an alternative embodiment of a bottle as is described herein.
Figure 11:
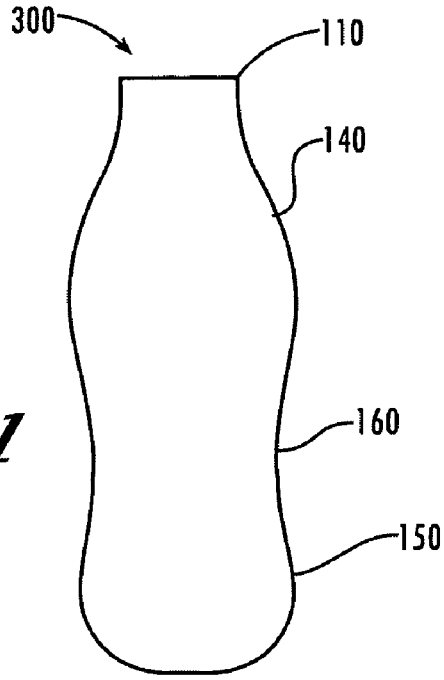
FIG. 11 is a side plan view of the bottle of FIG. 10.
Figure 13:
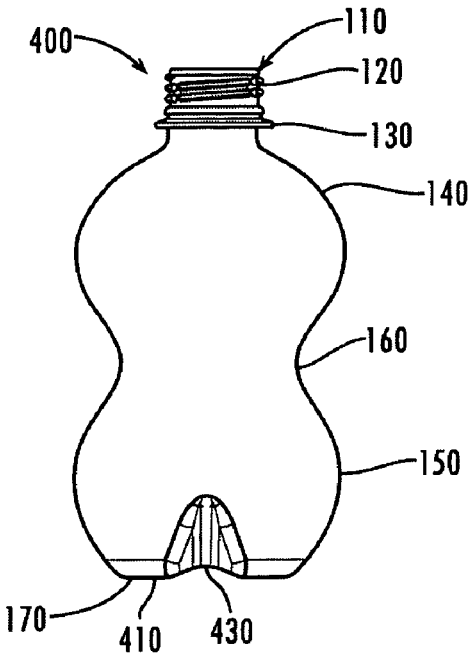
FIG. 13 is a front plan view of the bottle of FIG. 12.
Figure 12:
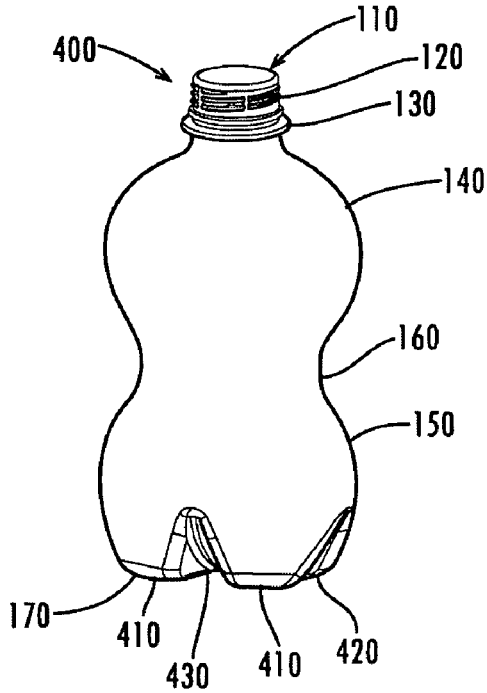
FIG. 12 is a perspective view of an alternative embodiment of a bottle with feet as is described herein.

FIGS. 10 and 11 show a further embodiment as is described herein of a flask 300. In this embodiment, the upper section 140 of the flask 300 is somewhat larger and rounder than the lower section 150. The middle section 160 largely remains substantially circular in shape. The net effect of this design is that the side view shown in FIG. 11 takes on a shape that is somewhat similar to the well-known contoured bottle sold by The Coca-Cola Company of Atlanta, Ga. as opposed to the oval shapes described above.

Figure 15:
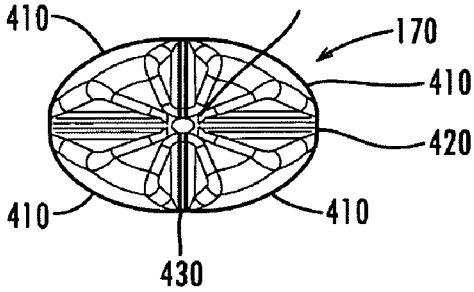
FIG. 15 is a bottom plan view of the bottle of FIG. 12.
Figure 14:
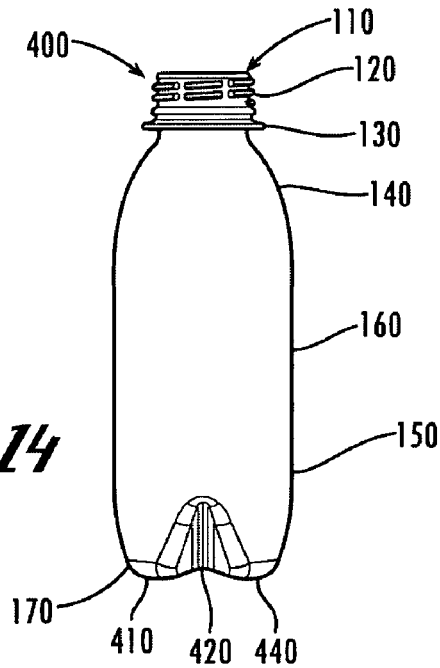
FIG. 14 is a side plan view of the bottle of FIG. 12.
Figure 17:
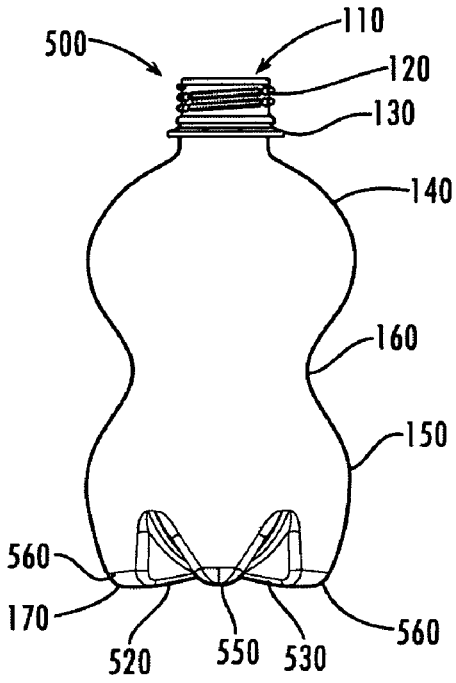
FIG. 17 is a front plan view of the bottle of FIG. 16.
Figure 16:
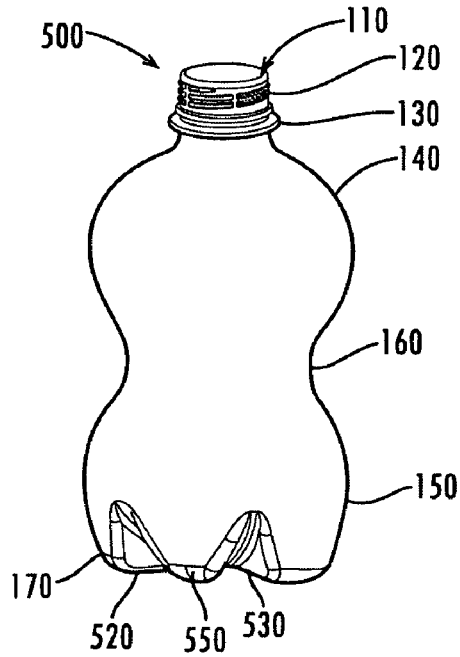
FIG. 16 is a perspective view of an alternative embodiment of a bottle with feet as is described herein.

FIGS. 12-15 show a further embodiment as is described herein of a flask 400. The flask 400 may be similar to any of the flasks described above but with the addition of a number of feet 410 along the bottom 170. The feet 410 allow the flask 400 to stand upright on its own. In this embodiment, four (4) feet 410 are formed and separated by a pair of indented ribs, a first rib 420 that bisects the longer dimension of the oval shaped lower section 150 and the bottom 170 (the X-axis as seen in FIG. 15) and a second rib 430 that bisects the shorter dimension (the Y-axis). Both ribs 420 extend upwards towards and into the lower section 150 from the bottom 170. The ribs 420, 430 intersect at a center point 440 on the bottom 170. The four (4) feet 410 are largely identical in shape. The feet 410 may be formed into the lower section 150 along the bottom 170. Alternatively, the feet 410 could be a separate element that may be attached to the bottom 170 via conventional means.

Figure 19:
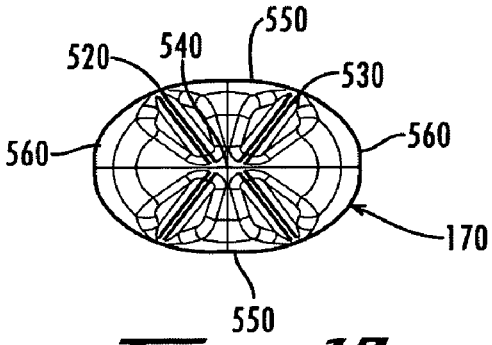
FIG. 19 is a bottom plan view of the bottle of FIG. 16.
Figure 18:
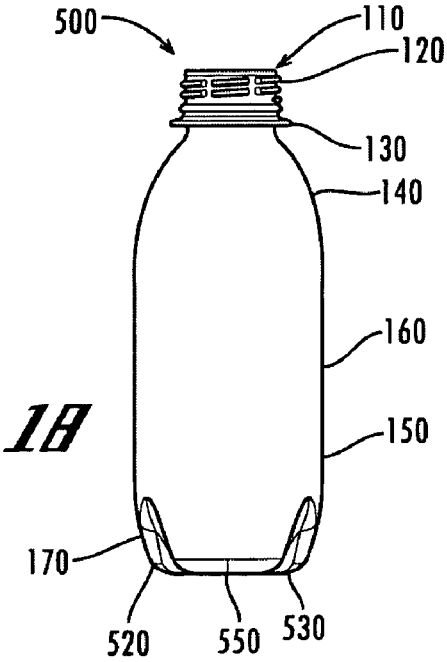
FIG. 18 is a side plan view of the bottle of FIG. 16.
Figure 21:
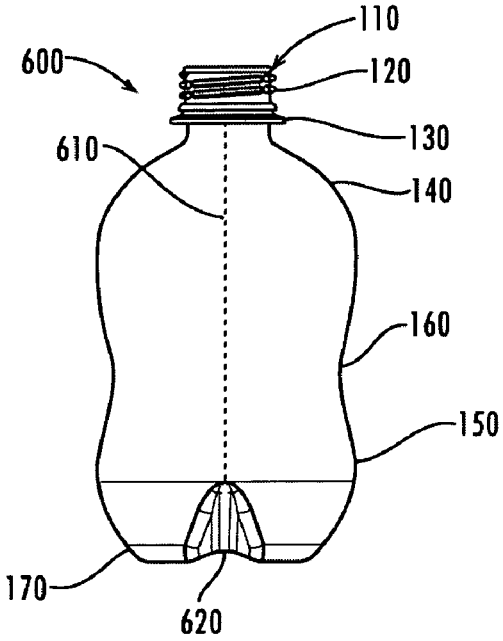
FIG. 21 is a front plan view of the bottle of FIG. 20.
Figure 20:
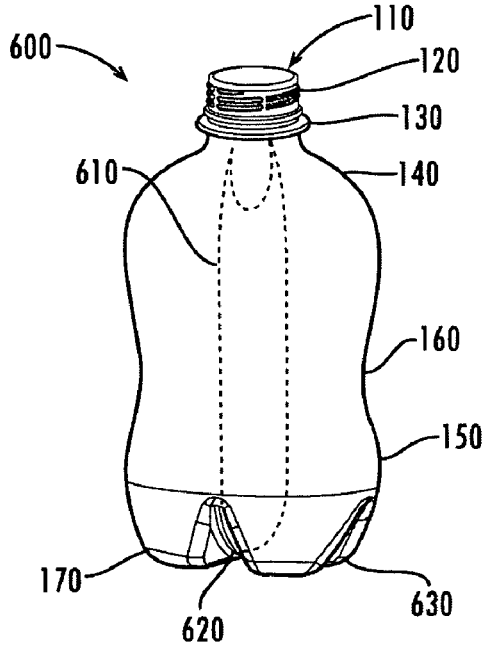
FIG. 20 is a perspective view of an alternative embodiment of a bottle with feet and an internal web as is described herein.

FIGS. 16-19 show a further embodiment as is described herein of a flask 500. The flask 500 may be similar to any of the flasks described above but with the addition of a number of feet 510 along the bottom 170. Similar to the previous embodiment, the feet 510 allow the flask 500 to stand upright on its own. In this embodiment, four (4) feet 510 are formed and separated by a pair of indented ribs, a first rib 520 and a second rib 430 that form an "X" shape as is seen in FIG. 19. The ribs 520, 530 intersect at a center point 540 on the bottom 170. Both ribs 520 extend upwards towards and into the lower section 150 from the bottom 170. The feet 510 include a pair of small feet 550 that extend across the short dimension of the oval shaped lower section 150 and the bottom 170 (along the y-axis as seen in FIG. 19) and a pair of large feet 560 that extend along the long dimension (the x-axis). The feet 510 may be formed into the lower section 150 along the bottom 170. Alternatively, the feet 510 could be a separate element that may be attached to the bottom 170 via conventional means.

Figure 23:
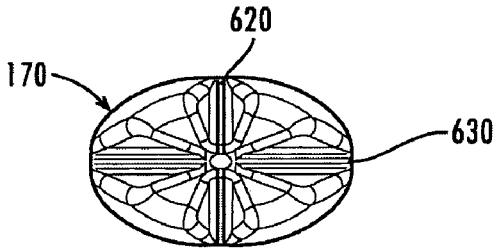
FIG. 23 is a bottom plan view of the bottle of FIG. 20.
Figure 22:
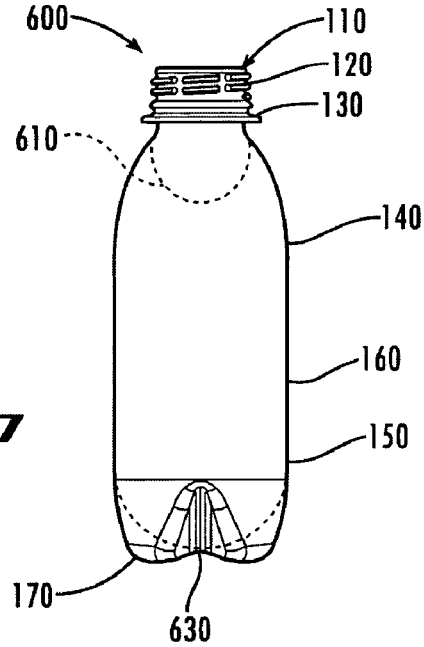
FIG. 22 is a side plan view of the bottle of FIG. 20.

FIGS. 20-23 show a further embodiment as is described herein of a flask 600. The flask 600 may be similar to the flask 400 described above but with the addition of an internal web 610. The web 610 may extend within the flask 600 from about the neck 110 to the bottom 170. The web 610 may divide the flask 600 largely into two sections so as to assist further in resisting deformation due to the internal pressures. The web 610 may have apertures about the neck 110 and/or the bottom 170 or otherwise so as to allow the beverage therein to flow from side to side if desired. The web 610 may align with and extend from a short rib 620 that bisects the shorter dimension of the oval shaped lower section 150 and the bottom 170 (the Y-axis as seen in FIG. 23) as opposed to a long rib 630.

It should be apparent that the foregoing relates only to the preferred embodiments of the present application and that numerous changes and modifications may be made herein without departing from the general spirit and scope of the invention as defined by the following claims and the equivalents thereof.

What is claimed is:

1. A beverage bottle, comprising:

a flattened upper lobe;

a flattened lower lobe;

a substantially circular transitional section; and wherein a side view comprises a substantially oval shape lengthwise.

2. The bottle of claim 1, further comprising a plastic material.

3. The bottle of claim 1, wherein a front view comprises a substantially hour glass shape.

4. The bottle of claim 1, wherein the flattened upper lobe and the flattened lower lobe comprise a same diameter.

5. The bottle of claim 1, wherein the flattened upper lobe and the flattened lower lobe comprise a different diameter.

6. The bottle of claim 1, wherein the flattened upper lobe and the flattened lower lobe comprise a same shape.

7. The bottle of claim 1, wherein the flattened upper lobe and the flattened lower lobe comprise a different shape.

8. The bottle of claim 1, wherein the flattened upper lobe and the flattened lower lobe comprise an oval shape.

9. The bottle of claim 8, further comprising a bottom with a plurality of feet positioned adjacent to the flattened lower lobe.

10. The bottle of claim 9, wherein the bottom comprises a pair of ribs positioned between the plurality of feet.

11. The bottle of claim 10, wherein the pair of ribs extends into the flattened lower lobe.

12. The bottle of claim 9, wherein the bottom comprises an oval cross-section.

13. The bottle of claim 1, further comprising a carbonated soft drink therein.

14. A beverage bottle, comprising:

a first section;

the first section comprising a first substantially oval cross-section;

a second section;

the second section comprising a second substantially oval cross-section;

a third section positioned in between the first section and the second section;

the third section comprising a substantially circular cross-section; and wherein a side view comprises a substantially oval shape.

15. The bottle of claim 14, wherein a front view comprises a substantially hour glass shape.

16. The bottle of claim 14, further comprising a plurality of feet positioned adjacent to the second section.

17. The bottle of claim 16, further comprising a pair of ribs positioned between the plurality of feet.

18. The bottle of claim 16, wherein the plurality of feet comprises a substantially oval cross-section.

* * * * *